US008033329B2

(12) United States Patent
Montgomery et al.

(10) Patent No.: US 8,033,329 B2
(45) Date of Patent: Oct. 11, 2011

(54) SYSTEM AND METHOD FOR CONNECTING WIRED DRILL PIPE

(75) Inventors: Michael A. Montgomery, Sugar Land, TX (US); Jonathan W. Brown, Noisy le Roi (FR)

(73) Assignee: Intelliserv, LLC., Houston, TX (US)

( * ) Notice: Subject to any disclaimer, the term of this patent is extended or adjusted under 35 U.S.C. 154(b) by 157 days.

(21) Appl. No.: 12/397,171

(22) Filed: Mar. 3, 2009

(65) Prior Publication Data

US 2010/0224416 A1 Sep. 9, 2010

(51) Int. Cl.
*E21B 19/16* (2006.01)

(52) U.S. Cl. ..... 166/65.1; 166/380; 166/242.1

(58) Field of Classification Search ..... 166/380, 166/65.1, 242.1; 175/320
See application file for complete search history.

(56) References Cited

U.S. PATENT DOCUMENTS 2,178,931 A * 11/1939 Crites et al. ..... 439/191
3,170,137 A * 2/1965 Brandt ..... 340/855.1
3,518,608 A * 6/1970 Papadopoulos ..... 439/191
4,506,432 A 3/1985 Smith
4,537,457 A * 8/1985 Davis et al. ..... 439/190
4,690,212 A * 9/1987 Termohlen ..... 166/65.1
4,799,544 A * 1/1989 Curlett ..... 166/65.1
5,334,801 A 8/1994 Mohn
6,367,564 B1 * 4/2002 Mills et al. ..... 175/40
6,688,396 B2 2/2004 Floerke et al.
6,929,493 B2 * 8/2005 Hall et al. ..... 439/191
7,114,970 B2 * 10/2006 Head ..... 439/191
2007/0102197 A1 5/2007 Rotthaeuser

OTHER PUBLICATIONS

International Application No. PCT/US2010/026050 Search Report and Written Opinion dated Jun. 22, 2010.

* cited by examiner

*Primary Examiner* — William P Neuder
*Assistant Examiner* — Catherine Loikith
(74) *Attorney, Agent, or Firm* — Conley Rose, P.C.

(57) ABSTRACT

A system and method for facilitating the formation of electrical connections between wired drill pipes is provided. Wired drill pipes comprise connection ends that each have a plurality of independent conductors. The independent conductors are arranged to enable a plurality of conductive connections between adjacent wired drill pipes when the wired drill pipes are physically connected.

25 Claims, 3 Drawing Sheets

SYSTEM AND METHOD FOR CONNECTING WIRED DRILL PIPE

BACKGROUND

In a variety of wellbore drilling operations, wired drill pipe is used to carry signals along the wellbore. Each wired drill pipe comprises conductive end connections that enable the connection of a series of wired drill pipes to form a wired drill string. The wired drill pipe is deployed by a drilling system having a rig, such as a land-based rig or an off-shore rig. The drill string is suspended in the wellbore by the rig; and a drill bit at the lower end of the drill string is used for drilling the wellbore.

Electrical connections between wired drill pipes are formed via a variety of mechanisms and in various configurations. For example, electrical connections between drill pipes have been created with the aid of several types of springs. However, such spring connections can have problems with long-term reliability, mating alignment, and other issues.

In other applications, inductive couplers have been used to enable transfer of signals along wired drill strings, and those connections are useful in many environments. However, inductors effectively amplify the connection resistance by the square of the number of turns in the inductor. For example, with 100 turn inductors, 10 milliohms of connection resistance effectively becomes 10 ohms of connection resistance when reflected through the inductors. As a result, very low connection resistance is desired, but low connection resistance is nearly impossible when forming wired drill pipe connections in the field. Debris between connectors, glazing, corrosion, and other effects can also increase the connection resistance.

BRIEF DESCRIPTION OF THE DRAWINGS

Certain embodiments of the invention will hereafter be described with reference to the accompanying drawings, wherein like reference numerals denote like elements, and.

DETAILED DESCRIPTION

In the following description, numerous details are set forth to provide an understanding of the present invention. However, it will be understood by those of ordinary skill in the art that the present invention may be practiced without these details and that numerous variations or modifications from the described embodiments may be possible.

The present invention generally relates to a system and method for facilitating communication of signals in a wellbore, such as along a wired drill string. The system and method may utilize wired drill pipes that have connection ends designed to facilitate the transfer of signals from each wired drill pipe to the next sequential wired drill pipe along the wired drill string. The connection ends may incorporate a plurality of unique or independent conductive connectors that engage each other upon connection of one of the wired drill pipes to the next sequential wired drill pipe. In many types of applications and environments, the plurality of independent conductive connectors can be used to avoid, for example, the amplifying effects of inductors.

Each wired drill pipe connection end may use independent conductive connectors to establish at least two conductive connections having low resistance and high reliability. The conductive connections may improve the transfer of signals, such as electrical signals, along the entire wired drill string which, in turn, facilitates operation of downhole equipment and receipt of data from the downhole equipment. In an embodiment, the conductive connectors are formed as at least two flat contact surfaces that may be isolated from each other. The flat contact surfaces of one wired drill pipe are forced into contact with the flat contact faces of the next adjacent drill pipe when the wired drill pipes are engaged by, for example, threaded engagement.

The wired drill pipe connection ends can vary in size, design and material selection, one type of connection end, for example, is a threaded connection end. The design of the threaded connection ends provides surfaces, e.g. faces, which can be used to position a plurality of conductive connectors separated by insulation material. Various mechanisms also can be used for wiping the conductive connector faces during engagement of the threaded connection end with a corresponding threaded connection end. Furthermore, various connection end configurations can be selected and used to establish multiple, e.g. two or more, signal transfer connections between wired drill pipes.

Figure 1:
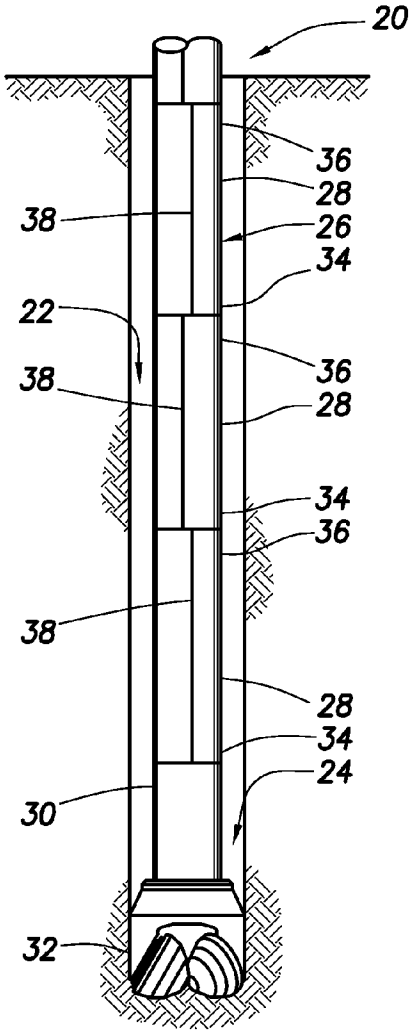
FIG. 1 is a schematic view of a plurality of wired drill pipes forming a wired drill string positioned in a wellbore, according to an embodiment of the present invention.

Referring generally to FIG. 1, a well system 20 is illustrated as deployed in a wellbore 22. As will be appreciated by those having ordinary skill in the art, the well system 20 may comprise other components and configurations and is shown as an example for explanatory purposes. The well system 20, as shown in FIG. 1, comprises downhole equipment 24 deployed on a wired drill string 26 formed with wired drill pipes 28 connected end to end. By way of example, downhole equipment 24 may comprise a bottom hole assembly 30 and a drill bit 32 used in forming wellbore 22.

In the embodiment illustrated, each wired drill pipe comprises a first connection end 34 and a second connection end 36. The first connection end 34 of one wired drill pipe 28 is connected to the second or corresponding connection end 36 of the next adjacent wired drill pipe 28. The wired drill pipes 28 are sequentially joined as the downhole equipment 24 is deployed further into wellbore 22 during, for example, a drilling operation. Additionally, each wired drill pipe 28 comprises a communication line, such as a conductor 38, which extends from the first connection end 34 to its second connection end 36. By way of example, the conductor 38 may comprise an electrical conductor in the form of an insulated wire or other type of conductor disposed within the wall forming the wired drill pipe 28.

If the wired drill pipes 28 are connected to each other, the conductors 38 are automatically and conductively coupled to form a communication line along the wired drill string 26 for transferring signals between, for example, downhole equipment 24 and a surface location. As illustrated in FIG. 1, the conductive connection between conductors 38 may be constructed to enable transfer of signals regardless of the rotational orientation of each wired drill pipe 28 with respect to the next adjacent wired drill pipe.

Figure 2:
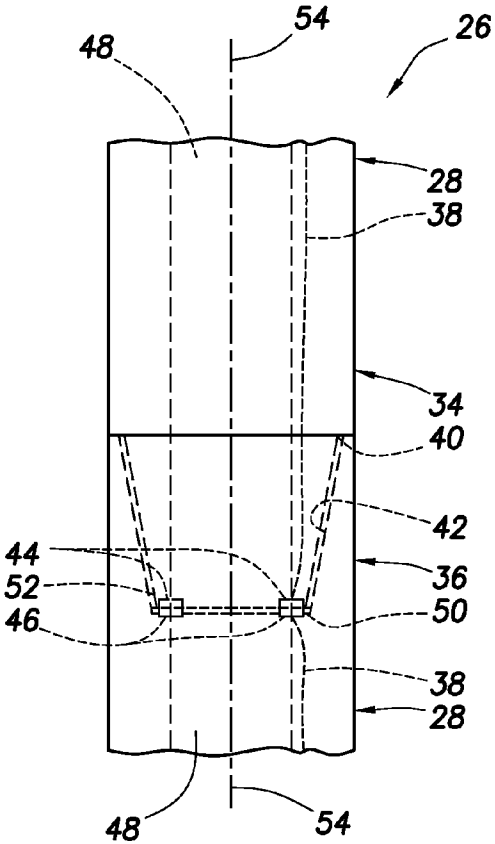
FIG. 2 is an enlarged view of a connection between adjacent wired drill pipes, according to an embodiment of the present invention.

The wired drill pipes 28 are connected to each other by various connection mechanisms. However, one example of a suitable connection mechanism is illustrated schematically in FIG. 2. In this example, each first connection end 34 comprises a threaded pin end 40, and each second connection end 36 comprises a threaded box end 42. Alternatively, the first connection end 34 can be formed as a threaded box end, and the second connection end 36 can be formed as a threaded pin end. With this type of connection, the threaded pin end 40 is threadably engaged with the corresponding threaded box end 42 of the next adjacent wired drill pipe 28 during assembly of wired drill string 26. One of ordinary skill in the art will appreciate that the ends, 40, 42 may be connected in various methods and using various mechanisms and the present invention is not limited to the ends, 40, 42 in threaded engagement.

Each connection end 34, 36 comprises a plurality of conductive connectors that are automatically engaged when connection end 34 is joined with connection end 36 of the next adjacent wired drill pipe. For example, first connection end 34 may comprise a plurality of first conductive connectors 44 that are operatively engaged with the conductor 38, which extends along the length of the wired drill pipe. Similarly, the second connection end 36 may comprise a plurality of second or corresponding conductive connectors 46 that also are operatively engaged with the conductor 38. When adjacent wired drill pipes 28 are joined together, the first conductive connectors 44 of one wired drill pipe 28 are moved into conductive engagement with the second conductive connectors 46 of the next adjacent wired drill pipe 28 to enable, for example, transfer of electric signals.

Conductive connectors 44, 46 are arranged to create a plurality of independent conductive paths between adjacent wired drill pipes 28 upon joining of the wired drill pipes 28. Furthermore, the conductive connectors 44, 46 are protected from the flows of fluid that may be directed along the interior, longitudinal passages 48 of the wired drill pipes 28. By way of example, the first conductive connectors 44 may be formed as generally flat surfaces along a face 50 of connection end 34, and second conductive connectors 46 may be formed as corresponding, generally flat surfaces along a face 52 of connection end 36. If the first connection end 34 is in the form of threaded pin end 40, the face 50 may be located along its distal end in an orientation generally perpendicular to a longitudinal axis 54 of the wired drill pipe 28. The corresponding face 52, containing the second conductive connectors 46, may be located at the base of the recessed, threaded box end 42 in an orientation generally perpendicular to the longitudinal axis 54. Accordingly, when threaded pin end 40 is threaded into threaded box end 42, the first conductive connectors 44 are forced or otherwise positioned against corresponding second conductive connectors 46 to form conductive connections along plural, independent conductive paths.

Figure 3:
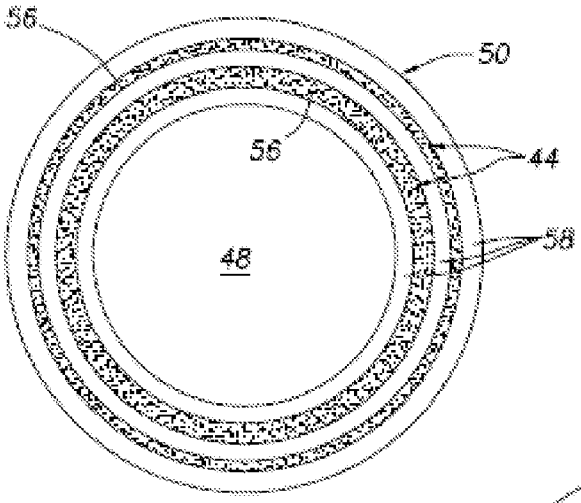
FIG. 3 is a view of an end face of a wired drill pipe connection end having a plurality of conductive connectors, according to an embodiment of the present invention.

Conductive connectors 44 and 46 may be designed in a variety of configurations and orientations depending on the type of connection formed between adjacent wired drill pipes. However, one example of a conductive connector arrangement is illustrated in FIG. 3. In this embodiment, a face containing conductive connectors is illustrated. For purposes of explanation, FIG. 3 is labeled as illustrating face 50 containing first conductive connectors 44; however the illustration also is representative of the corresponding face 52 containing second conductive connectors 46. For example, the corresponding face 52 has a similar arrangement of second conductive connectors 46 that engage, e.g. contact, first conductive connectors 44 upon engagement of adjacent wired drill pipes 28.

Referring again to FIG. 3, the conductive connectors 44 are arranged as concentric rings 56 separated by insulating material 58 that also may be arranged in concentric layers to isolate the concentric rings 56. In this embodiment, two concentric rings 56 and the cooperating insulating material 58 span the entire 360 degrees of the connection surface provided by face 50. Of course, the insulating material 58 may only span a portion of the connection surface of the face 50. Use of concentric rings 56 enables conductive connections along a plurality of independent paths regardless of the rotational orientation of adjacent wired drill pipes with respect to each other.

Referring again to FIG. 3, the one or more of the rings of insulating material 58 can additionally function as a fluid seal. This can prevent fluid from inside or outside of the wired drill pipe 28 from reaching the conductive connectors 44. Sealing may not be needed in non-conductive environments such as oil-based mud, but may be important for conductive environments such as water-based mud, to avoid any shunt resistance between the conductive connectors 44 that might be caused by borehole fluids contacting both conductive connectors 44 at the same time. The seals can be selected from various solutions, such as o-rings or washers, as long as the seals are made of insulating materials.

Figure 4:
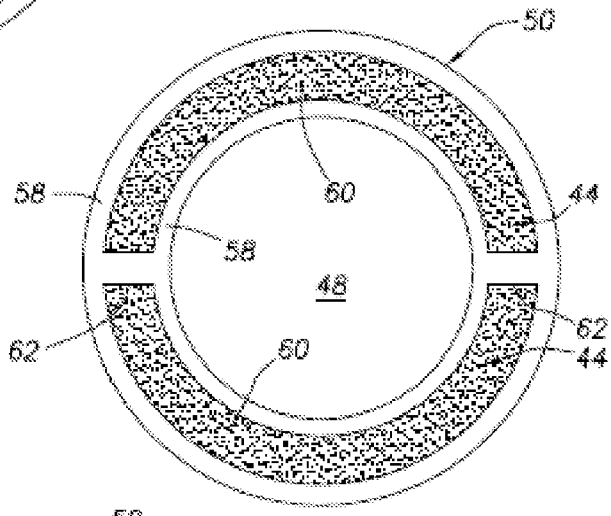
FIG. 4 is a view of an end face of a wired drill pipe connection end having a plurality of conductive connectors, according to another embodiment of the present invention.

In another embodiment illustrated in FIG. 4, one of the faces, e.g. the face 50, comprises the plurality of conductive connectors 44 arranged in a pattern of contact sections 60 enclosed by insulation material 58. The contact sections 60 may be formed as generally flat surfaces that extend in the shape of a ring along face 50. However, the ring is interrupted by shorter sections 62 of insulating material 58 to provide separate, independent conductive contacts. By way of example, each contact section 60 may extend along a substantial portion of the ring, e.g. 160 degrees, and insulating sections 62 may extend along the ring a much shorter distance, e.g. 20 degrees, to circumferentially separate the contact sections 60. However, the lengths of contact sections 60 and insulating sections 62 may be changed as desired for a specific application. As illustrated as an embodiment of the invention, the short insulating sections 62 are positioned approximately 180 degrees apart.

Figure 5:
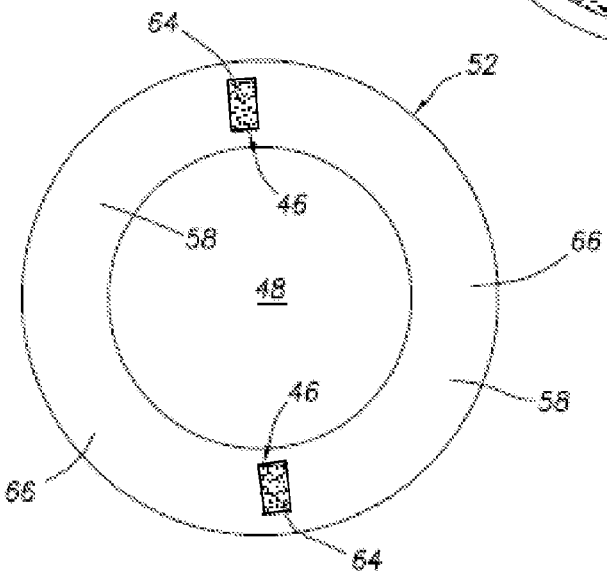
FIG. 5 is a view of a corresponding end face of a wired drill pipe connection end for conductive engagement with the wired drill pipe connection end face illustrated in FIG. 4, according to an embodiment of the present invention.

The corresponding face, e.g. the face 52, is designed with relatively short conductive contact sections 64 separated by longer sections 66 of insulating material 58, as illustrated in FIG. 5. By way of example, the short contact sections 64 may each cover approximately 10 degrees of the ring formed by the face 52. The threads on threaded pin end 40 and threaded box end 42 are arranged so that when a connection is formed between adjacent wired drill pipes 28 with, for example, a typical makeup torque, the contact between short contact sections 64 and corresponding longer contact sections 60 occurs generally at or near the center of contact sections 60. This provides a substantial margin, e.g. over 60 degrees, in each direction so that if the connection is under or over rotated due to under or over torquing of the connection, the connection still forms proper conductive contact. The arrangement of contact sections and insulating sections also ensures that the contacts are unable to short circuit regardless of the relative rotational orientations of wired drill pipes 28.

Figure 6:
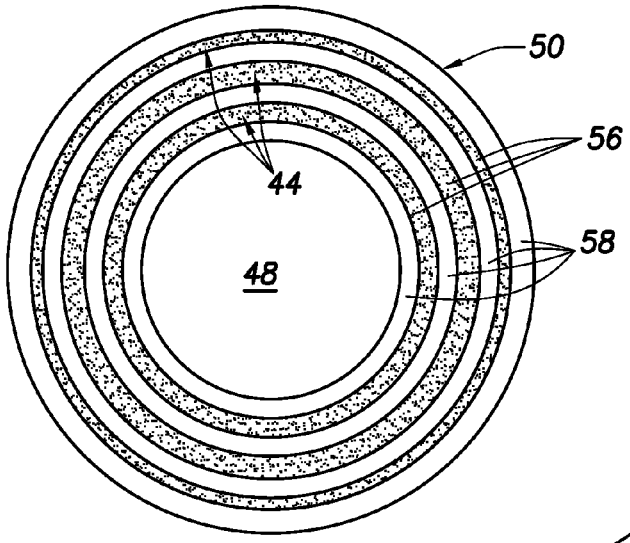
FIG. 6 is a view of an end face of a wired drill pipe connection end having a plurality of conductive connectors, according to another embodiment of the present invention.

In some applications, additional independent conductive contacts may also be established. In the embodiment illustrated in FIG. 6, for example, at least three conductive, concentric rings 56 are isolated by insulating material 58 to create independent signal flow paths. By using additional conductive connectors, the wired drill string 26 can be adapted to carry a wider variety of signals. For example, additional conductive connectors 44, 46, as illustrated in FIG. 6, can be used to enable the transmission of both power signals and communication signals by providing both communication and power channels.

Figure 7:
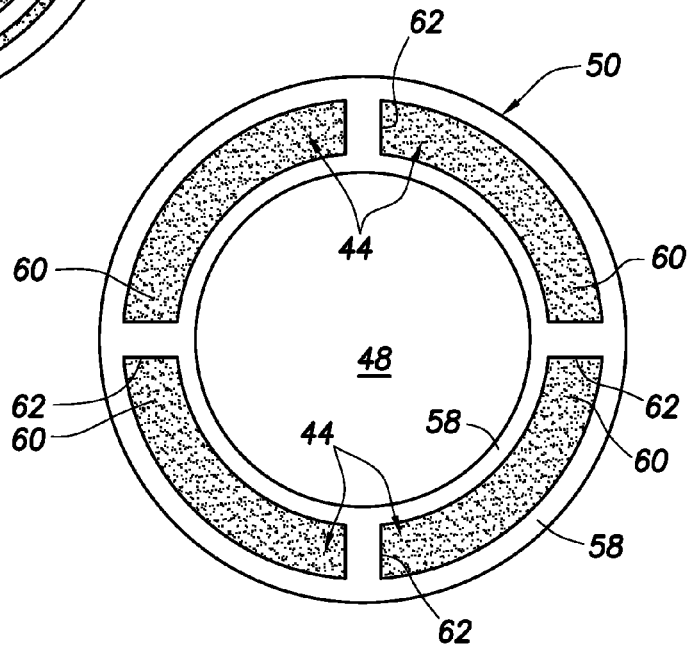
FIG. 7 is a view of an end face of a wired drill pipe connection end having a plurality of conductive connectors, according to another embodiment of the present invention.

Referring generally to FIG. 7, another embodiment of conductive connectors 44, 46 is illustrated as providing a plurality, e.g. at least four, contact sections 60 arranged in a ring and separated by insulating sections 62 along a suitable face 50 or 52. The corresponding face is arranged with the proper number of short contact sections 64, e.g. four contact sections 64, to enable communication of signals across the wired drill pipe connection over an increased number of conductive contacts, e.g. the four illustrated conductive contacts.

Figure 8:
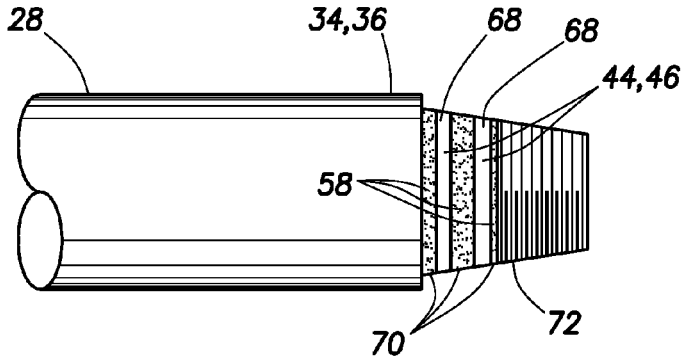
FIG. 8 is a view of a wired drill pipe connection end having a plurality of conductive connectors, according to another embodiment of the present invention.

In other designs, the conductive contacts 44, 46 need not be created as generally flat surfaces along an end face. As illustrated in FIG. 8, for example, the conductive contacts 44, 46 may be formed as annular conductive rings 68 separated by annular sections 70 formed of insulating material 58. In the example illustrated, the annular conductive rings 68 are positioned along an extending pin 72 of threaded pin end 40. Corresponding annular conductor rings are positioned along the side wall within the threaded box end 42. As the threaded pin end 40 of one wired drill pipe 28 is threadably engaged with the threaded box end 42 of the next adjacent drill pipe 28, the annular conductive rings 68 and the corresponding annular conductive rings are positioned into conductive contact. However, other arrangements and configurations of faces, conductive connectors, connection ends, and connection mechanisms may be used to securely establish mechanical connection as well as conductive connections along a plurality of independent paths.

Generally, the well system 20 may be constructed with a variety of well equipment components, including various configurations of the wired drill string. Additionally, the wired drill string may be formed of wired drill pipes having many sizes and structures. For example, the wired drill pipes may comprise an assortment of communication lines for transferring many types of signals. Furthermore, the connection ends may employ various numbers, arrangements and configurations of the conductive contacts to establish plural conductive connections and independent electrical current flow paths. The plurality of independent, conductive connections greatly facilitates the dependable transfer of desired signals while avoiding, for example, the multiplication effect of an inductor on the contact resistance. The connection mechanisms described herein also improve the reliability of the connection relative to conventional connections, such as spring connections.

Although only a few embodiments of the present invention have been described in detail above, those of ordinary skill in the art will readily appreciate that many modifications are possible without materially departing from the teachings of this invention. Accordingly, such modifications are intended to be included within the scope of this invention as defined in the claims.

What is claimed is:

1. A system of connected drill pipe, comprising:

a first wired drill pipe having a connection end with a plurality of first conductive surfaces arranged as a ring interrupted by sections of insulating material; and a second wired drill pipe having a corresponding connection end engaged with the connection end, the corresponding connection end having a plurality of second conductive surfaces arranged as a ring interrupted by sections of insulating material;

wherein an arc of each of the second conductive surfaces is less than an arc of each of the first conductive surfaces and less than an arc separating the first conductive surfaces, and wherein an arc of each of the first conductive surfaces is greater than the arc separating the first conductive surfaces.

2. The system as recited in claim 1, wherein each of the first conductive surfaces are configured to engage no more than one of the second conductive surfaces upon engagement of the connection end with the corresponding connection end regardless of the rotational orientation of the second wired drill pipe with respect to the first wired drill pipe.

3. The system as recited in claim 1, wherein the second conductive surfaces and the first conductive surfaces are configured to provide over sixty degrees of rotational margin in each direction while providing proper conductive contact.

4. The system as recited in claim 1, wherein an arc of each of the second conductive surfaces is smaller than an arc of each of the sections of insulating material separating the second conductive surfaces.

5. The system as recited in claim 1, wherein threads of the connection end and the corresponding connection end are configured to position each of the second conductive surfaces near the center of one of the first conductive surfaces when the first and second wire drill pipes are engaged with a predetermined torque.

6. The system as recited in claim 1, wherein the plurality of second conductive surfaces is configured to prevent shorting of the first conductive surfaces when the first and second wired drill pipes are engaged.

7. The system as recited in claim 1, wherein at least a portion of the insulating material functions as a fluid seal.

8. The system as recited in claim 1, wherein the connection end is a threaded pin end and the plurality of first conductive surfaces is located on a face of the threaded pin end.

9. The system as recited in claim 8, wherein the corresponding connection end is a threaded box end and the plurality of second conductive surfaces is located on a face of the threaded box end.

10. A method for connecting wired drill pipe, comprising:

forming wired drill pipes such that each wired drill pipe comprises a threaded pin end and a threaded box end;

locating a plurality of insulated conductors in each threaded pin end and a plurality of corresponding insulated conductors in each threaded box end; and conductively engaging the plurality of insulated conductors with the plurality of corresponding insulated conductors to establish current flow paths;

wherein the insulated conductors and the corresponding insulated conductors each comprise sections of a ring interrupted by insulating material, and an arc of each section of the ring of the corresponding insulated conductors is less than an arc of each section of the ring of the insulated conductors and less than an arc of insulating material interrupting the insulated conductors, and an arc of each section of the ring of the insulated conductors is greater than the arc of insulating material separating each section of the ring of the insulated conductors.

11. The method as recited in claim 10, wherein the conductively engaging the plurality of insulated conductors includes threading the threaded pin end of one wired drill pipe with the threaded box end of an adjacent wired drill pipe.

12. The method as recited in claim 10, wherein locating comprises circumferentially separating the plurality of corresponding insulated conductors by sections of insulating material that extend along the ring over a greater distance than the insulated conductors.

13. The method as recited in claim 10, wherein locating comprises circumferentially separating the plurality of corresponding insulated conductors by sections of insulating material that extend along the ring over a greater distance than the corresponding insulated conductors.

14. The method as recited in claim 10, wherein locating comprises positioning the plurality of insulated conductors such that each of the insulated conductors conductively engages no more than one of the corresponding insulated conductors regardless of the rotational orientation of adjacent wired drill pipes with respect to each other.

15. The method as recited in claim 10, wherein locating comprises locating the plurality of insulated conductors on a face of the threaded pin end oriented generally perpendicular to a longitudinal axis of the wired drill pipe.

16. A system, comprising:

a drill pipe having a conductor running between a first connection end and a second connection end, the conductor being operatively coupled with a conductive connector arrangement at the first connection end and the second connection end, wherein the first connection end and the second connection end each comprise a plurality of conductive contact surfaces separated by insulation material;

wherein an arc of each section of the conductive contact surfaces of the second connection end is less than an arc of each section of a ring of the conductive contact surfaces of the first connection end and less than an arc of insulating material separating each section of the ring of the conductive contact surfaces of the first connection end, and an arc of each section of the ring of the of the conductive contact surfaces of the first connection end is greater than the arc of insulating material separating each section of the ring of the conductive contact surfaces of the first connection end.

17. The system as recited in claim 16, wherein the conductive contact surfaces are generally flat surfaces located on a face of each of the first and second connection ends.

18. The system as recited in claim 16, wherein at least a portion of the insulation material functions as a fluid seal.

19. The system as recited in claim 16, wherein the conductive contact surfaces of the second connection end comprise a smaller arc than the insulating material separating the conductive contact surfaces of the second connection end.

20. The system as recited in claim 16, wherein the first connection end and the second connection end comprise a threaded pin end and a threaded box end, respectively.

21. A method, comprising:

providing a plurality of wired drill pipes;

disposing a plurality of annular conductive rings separated by annular sections of insulating material at each end of each of the drill pipes;

connecting the plurality of wired drill pipes; and forming a plurality of independent electrical connections at each connection of the wired drill pipes.

22. The method as recited in claim 21, wherein disposing comprises positioning the annular conductive rings along a pin of a threaded pin end and a side wall within a threaded box end.

23. The method as recited in claim 21, wherein forming comprises engaging a plurality of conductive rings of one wired drill pipe against corresponding conductive rings of a next sequential wired drill pipe.

24. The method as recited in claim 21, wherein forming comprises forming at least two independent electrical connections.

25. The method as recited in claim 21, wherein forming comprises forming at least three independent electrical connections.

* * * * *